United States Patent [19]

Ruhe

[11] 4,384,697

[45] May 24, 1983

[54] TUBE BUNDLE SUPPORT STRUCTURE

[75] Inventor: Anthony Ruhe, Fonthill, Canada

[73] Assignee: Foster Wheeler Energy Corp., Livingston, N.J.

[21] Appl. No.: 273,261

[22] Filed: Jun. 12, 1981

[51] Int. Cl.[3] ..... F16L 3/22

[52] U.S. Cl. ..... 248/68 R; 165/162

[58] Field of Search ..... 248/68 R, 68 CB, 69; 165/162, 82; 52/687, 220

[56] References Cited

U.S. PATENT DOCUMENTS

| | | | |
|---|---|---|---|
| 1,500,895 | 7/1924 | Rover | 165/162 X |
| 1,815,750 | 7/1931 | Watts | 165/162 X |
| 1,852,363 | 4/1932 | Parent | 165/162 |
| 2,161,019 | 6/1939 | Coy | 165/82 |
| 2,805,049 | 9/1957 | Katholi | 165/162 X |
| 3,439,737 | 4/1969 | Boorman et al. | 165/109 |
| 3,626,481 | 12/1971 | Taylor et al. | 165/162 |
| 3,637,008 | 1/1972 | Michel et al. | 165/69 |
| 3,916,990 | 11/1975 | Ruhe et al. | 165/158 |

*Primary Examiner*—William H. Schultz
*Assistant Examiner*—Ramón O. Ramírez
*Attorney, Agent, or Firm*—Marvin A. Naigur; John E. Wilson; Warren B. Kice

[57] ABSTRACT

A support structure for a bundle of tubes includes a plurality of parallel grid strips having indentations, wherein the strips are fixed in pairs and are attached by fasteners to other pairs to define a support grid. The indentations of adjacent pairs of grid strips are in alignment to receive the tubes and maintain them in a spaced arrangement. The support grid is reinforced by key strips which extend along opposite sides of the support grids. The grids are prevented from moving along the tubes by collars secured to selected tubes adjacent to the sides of the support grid. The bundle may be arranged in sections wherein a support grid is provided for each section, in which case keeper bars having flanges are inserted between adjacent sections to support the sections with respect to one another and to prevent the shifting of one section with respect to another.

12 Claims, 11 Drawing Figures

TUBE BUNDLE SUPPORT STRUCTURE

BACKGROUND OF THE INVENTION

In heat exchangers employing tubes arranged in a bundle, it is necessary to maintain the individual tubes of the bundle in a parallel, spaced relationship. Such spacing is important to allow the even transfer of heat from fluids flowing within the tubes to fluids flowing around the outside of the tubes. There are advantages to employing heat exchangers as gas turbine regenerators, vapor generators, feed water heaters, and the like, in which a first fluid is passed through the tubes and a second fluid is passed in counterflow relation to the first fluid around the outside of the tubes along the length thereof. In heat exchangers of this type, it is also necessary for the support structure maintaining the tubes in spaced, parallel relationship to be open to permit fluid to flow by.

U.S. Pat. No. 3,916,990, issued Nov. 4, 1975 to Anthony Ruhe et al and assigned to the assignee of the present application, discloses a heat exchanger in which a plurality of elongated tubes are supported in a spaced parallel relationship between two tube sheets, and in which intermediate support units are provided between the tube sheets, the support units comprising a plurality of interconnected grid strips formed into a grid pattern for permitting fluid to flow through. The support units are preassembled in a shop by welding the strips together at various spaced points. Such preassembled support units or grids are well suited for straight lengths of tubing, for the tubes can be slid through the support units and into the tube sheets during the assembly of the heat exchanger.

Known tube-type heat exchangers for the above-mentioned purposes usually include a bundle of straight tubes extending between inlet and outlet headers at opposite ends of a shell or casing. A drawback of this type of heat exchanger is the tendency of some tubes to develop high thermal stresses as a result of relative expansion compared to other tubes in the bundle. This is attributable to the lack of uniform gas flow across the width of the bundle. A type of tube heat exchanger which overcomes this problem includes an elongated bundle of U-shaped tubes mounted within a large U-shaped shell or casing. In addition to avoiding the tube stressing mentioned above, the U-shaped heat exchanger is characterized by a reduction in required materials and construction costs. For example, fewer tube-to-tube sheet joints are associated with such a heat exchanger than would be required for a conventional tube-type heat exchanger of equivalent capacity. However, one requirement of such U-tube heat exchangers which does not apply to other heat exchangers is the need for intermediate supports in the area of the U-bend to prevent vibration of the tubes and to maintain the tube bundle in a properly spaced orientation. Furthermore, where the flow outside the tubes is parallel to the tubes, the parallel flow must be maintained in the U-bend area as well. This imposes on the intermediate U-tube supports the further requirement of high porosity to enable fluid to flow through the support structure with very low flow resistance.

The previously mentioned preassembled grids are not suitable for the area of the U-bend because the tubes cannot be slid with respect to preassembled grids where the tubes bend. Thus, it also required that the intermediate supports in the area of the U-bend can be built up layer-by-layer as the tube bundle is built up.

SUMMARY OF THE INVENTION

It is, therefore, an object of the present invention to provide a tube support structure which is suitable for supporting a bundle of bent tubes in an evenly spaced relationship in the region of the bends.

It is a further object of the present invention to provide a tube support system which lends itself to being assembled in the tube bundle as the tube bundle is being assembled.

It is a still further object of the present invention to provide a support structure capable of being assembled in place and being porous, so that a heat exchange medium may flow through it.

It is another object of the present invention to provide a tube support structure which may be assembled in place to accommodate tube bundles of various sizes and shapes.

Toward the fulfillment of these and other objects, the tube support structure of the present invention comprises a plurality of elongated, corrugated grid strips arranged in pairs, stacked, and secured together by fasteners to maintain the various tubes of a tube bundle in a prearranged, evenly spaced pattern. The assembled pairs of strips define a grid or matrix which maintains the tubes of the bundle in a regular spaced arrangement and restrains them from vibration. The grid strips of the grid are reinforced in their assembled, stacked position by key strips which extend in pairs transverse to the grid strips along opposite sides of the grid strips, the key strips in each pair being secured to one another at their ends. The tube bundle may be supported in sections, with the support structure according to the present invention including a plurality of grids positioned in alignment with one another and spaced by elongated keeper bars which extend between adjacent sections in a direction transverse to both the tube bundle and the key strips. Flanges are secured to the ends of the keeper bar and are engaged with the sides of the section to prevent adjacent sections from shifting with respect to one another. Where one section is positioned above another section, the keeper bars provide a support surface for the upper section. Collars are secured to some of the tubes adjacent the grids and the keeper bars to restrain them from movement along the tubes.

DETAILED DESCRIPTION OF THE PREFERRED EMBODIMENT

Figure 2:
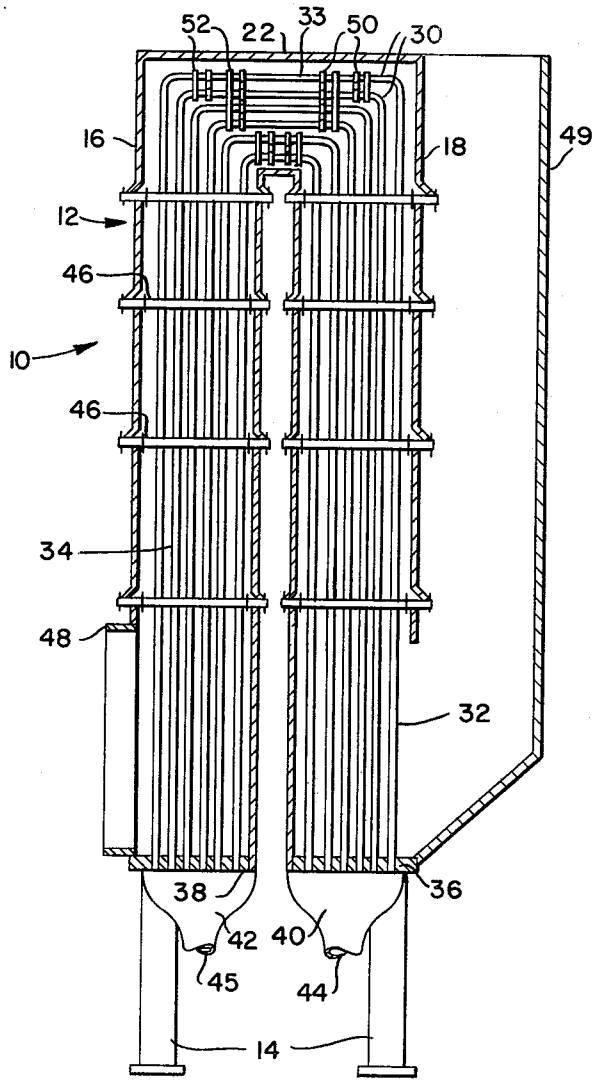
FIG. 2 is a cross section along the line 2—2 in FIG. 1, schematically showing support structures according to the present invention in position on a tube bundle.
Figure 1:
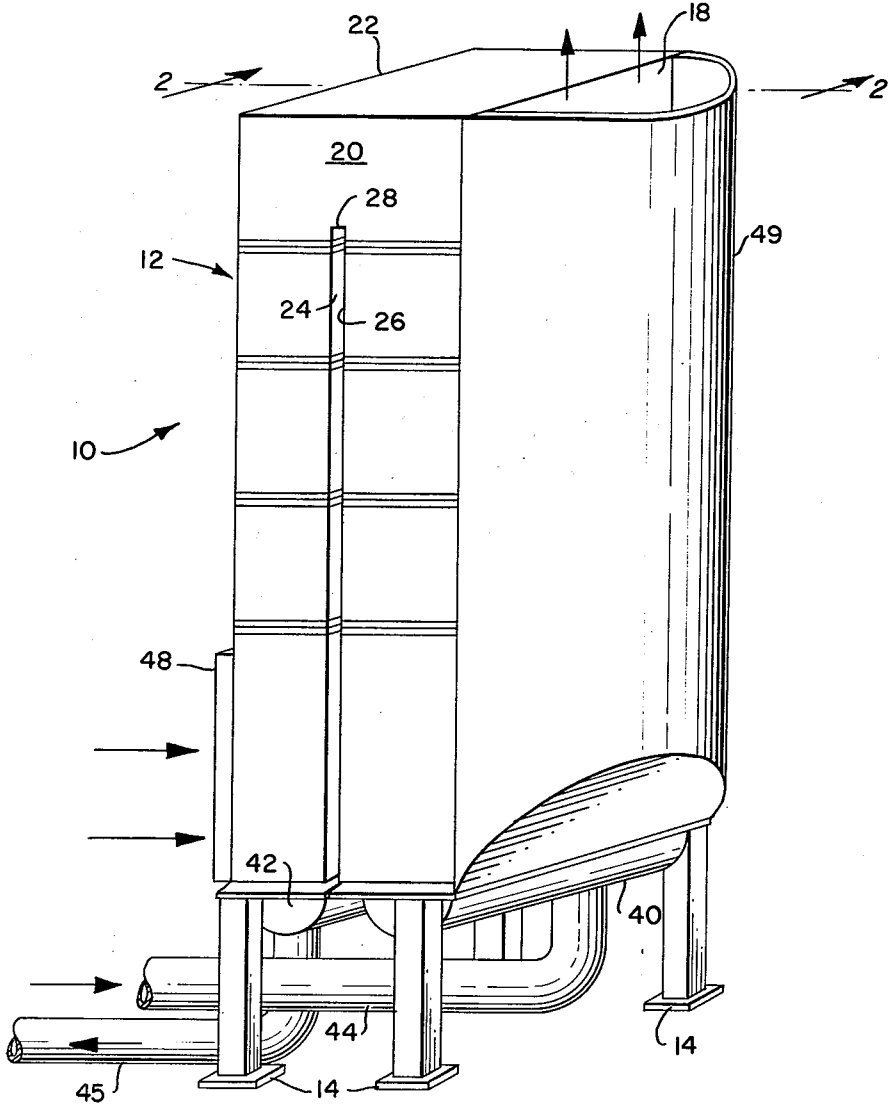
FIG. 1 is a perspective view of a U-shaped heat exchanger well suited to employ the support structure of the present invention.

FIGS. 1 and 2 illustrate a heat exchanger 10 which is well suited for employing the support structure of the present invention. The heat exchanger 10 includes an inverted generally U-shaped housing 12 which is supported at the bottom by a plurality of feet 14. The housing 12 includes a front wall 16 (FIG. 2), a rear wall 18, a pair of side walls 20 (one of which is shown), a top closure 22, and a pair of intermediate walls 24 and 26 connected at their upper ends by a horizontal member 28.

As is shown in FIG. 2, a plurality of elongated inverted U-shaped tubes 30 is disposed within the housing 12. Each tube 30 has a first straight upflow portion 32, a U-portion 33 containing bends and a second straight downflow portion 34. The inlet ends of the first straight portions 32 are secured in a tubesheet 36, and the outlet ends of the second straight portions 34 are secured in a tubesheet 38. An inlet header 40 is welded to the underside of the tube sheet 36, and a similar outlet header 42 is welded to the underside of the tubesheet 38. A supply pipe 44 is adapted to deliver a first fluid, such as air, to the inlet header 40 and an outlet pipe 45 is adapted to convey the first fluid away from the outlet header 42.

A series of preassembled grids 46 are positioned in intermediate positions along the tubes 30 to keep the tubes 30 evenly spaced within the housing 12 and to dampen vibration of the tubes which can occur as fluids pass through and over the tubes. Because the preassembled grids 46 are to be positioned along the straight portions 32 and 34 of the tubes 30, the tubes 30 can be slid through the preassembled grids 46 into position for attachment to the tubesheets 36 and 38.

A second fluid, such as a gas, enters the housing 12 through an inlet 48, passes upwardly over the straight downflow portion 34, across the U-portion 33, then downwardly over the straight upflow portion 32 and out through a stack 49. Thus, it is essential that all of the tube support structures in the path of the second fluid be porous to allow the second fluid to flow. The first fluid flows through the tubes 30 in a direction opposite to the flow of the second fluid.

Supports are also needed in the area of the bends to prevent vibration of the tubes 30 in that area and to maintain them in an evenly spaced relationship. The preassembled intermediate grids 46 are not suitable for the bend areas, since the bends in the tubes 30 cannot slide through the grids so that the ends of the tubes are in a position to be secured to the tubesheets 36 and 38. As is illustrated in FIG. 3, the U-portion of the U-shaped heat exchanger 10 includes a plurality of tube supports or grids 50 which are assembled near the bends and are porous to the flow of fluid.

Figure 3:
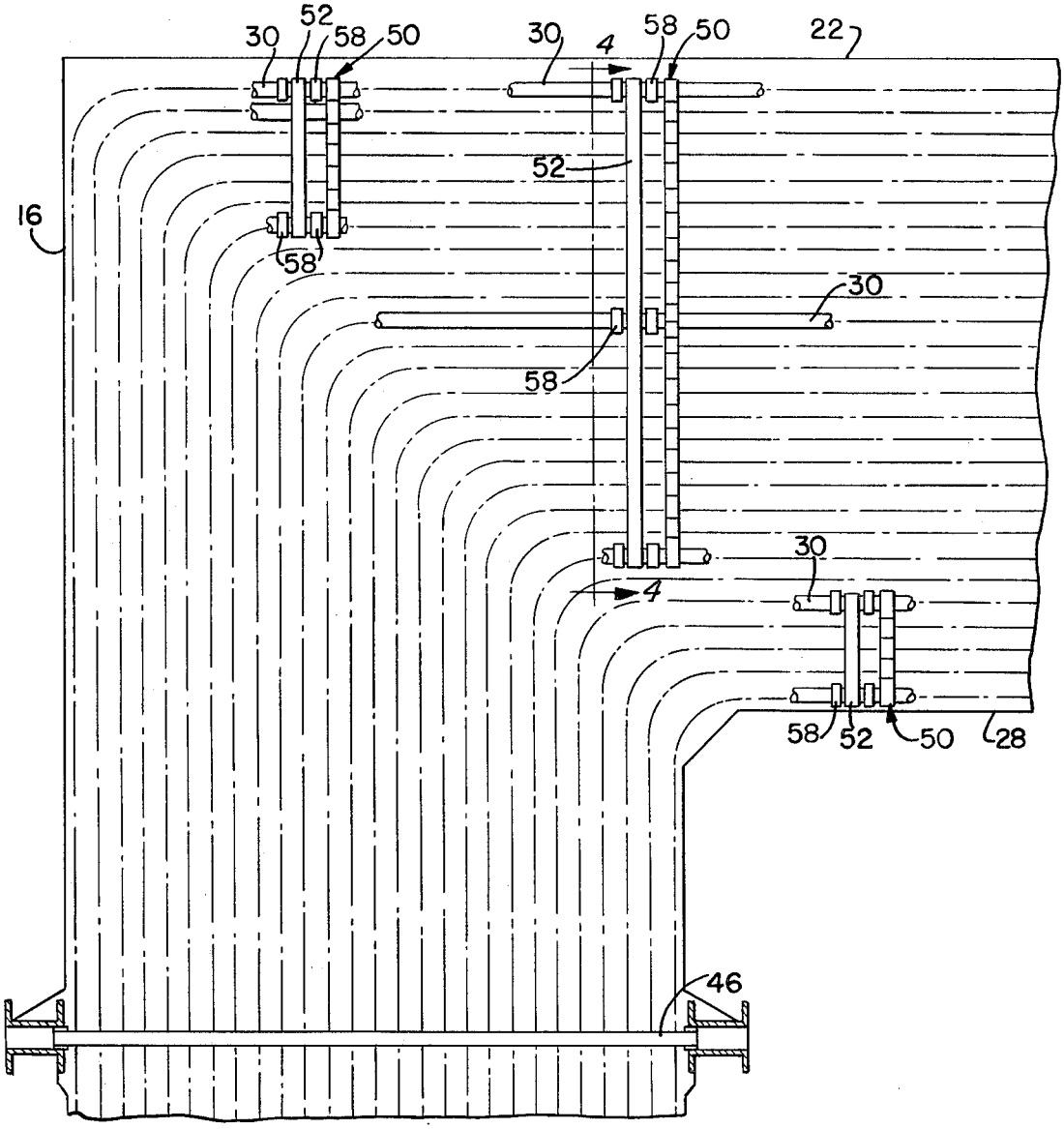
FIG. 3 is an enlarged fragment of the cross section of FIG. 2.

A plurality of keeper bars 52 rests on the top layer of tubes 30, most of which are shown schematically in FIG. 3, in parallel, spaced positions near the bends in the tubes. U-tube heat exchangers are typically of such a size that they are assembled on their sides, with the U-shaped tubes 30 lying in a horizontal plane. With the tubes 30 in such an orientation, the height of the tube bundle is typically on the order of 10 feet. As a result, it is convenient for workers to assemble the bundle in two 5 foot high sections. When the lower section of the tube bundle has been assembled, the keeper bars 52 are placed across the top of the section, lying on the tubes 30. Then, as the upper section of the tube bundle is assembled, its weight is supported by the keeper bars 52.

Figure 4:
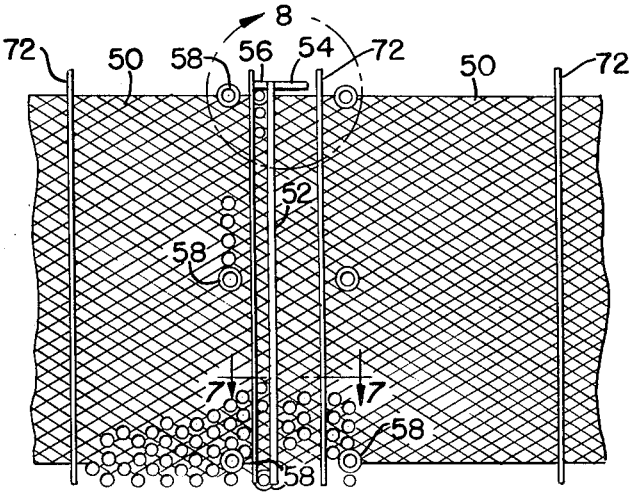
FIG. 4 is a cross section taken along the line 4—4 of FIG. 3.
Figure 8:
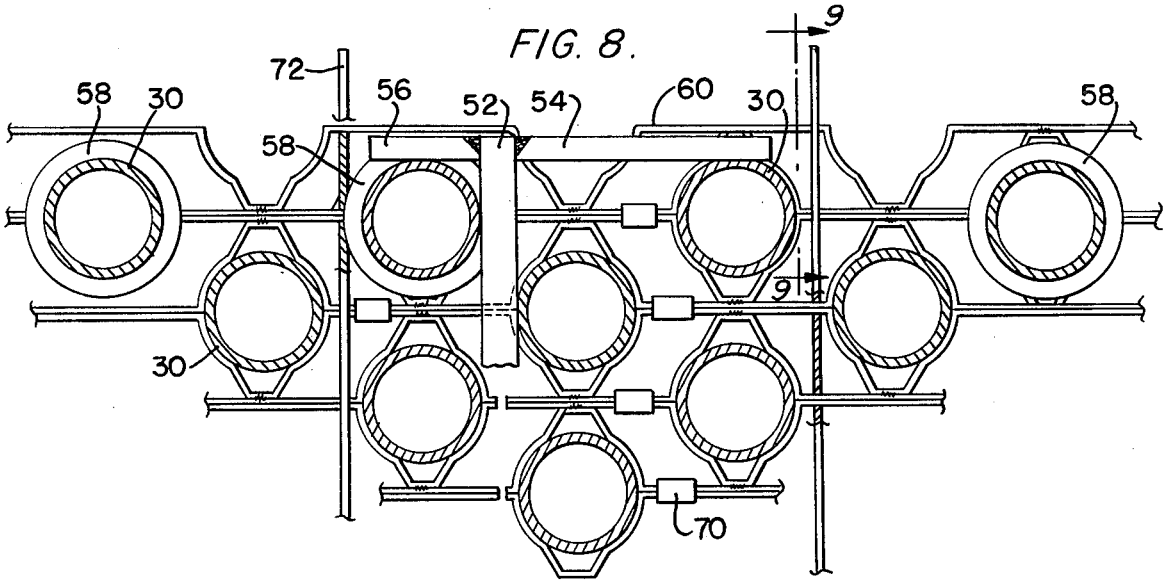
FIG. 8 is an enlarged fragment of FIG. 4.
Figure 11:
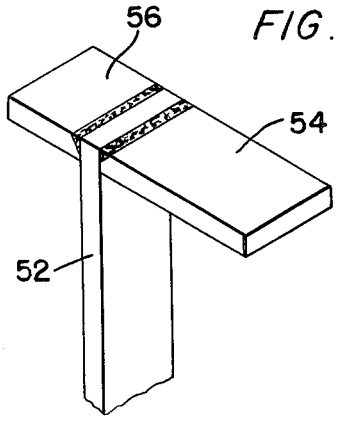
FIG. 11 is a perspective view of a portion of a keeper bar.

Moreover, as is better illustrated in FIGS. 4, 8 and 11, flanges 54 and 56 are welded or otherwise secured to the ends of the keeper bars 52, from which they extend transversely to the length of the tubes 30, along the sides of the tube bundle sections. This arrangement maintains the adjacent sections of the tube bundle in alignment, preventing shifting of the sections with respect to one another. In addition, it eliminates any tendency for the layers of tubes 30 near the interface of the sections to spread out from their evenly spaced arrangement. Collars 58 are welded or otherwise suitably secured to several of the tubes 30 on which the keeper bars 52 rest, adjacent to the edges of the keeper bars 52, in order to prevent the keeper bars 52 from shifting sideways along the length of the tubes 30. Although the keeper bars 52 in the embodiment of the present invention described herein are horizontally oriented between two adjacent sections of the tube bundle during the assembly, the tube bundle can be arranged in additional sections, with keeper bars positioned between all of the adjacent sections. Furthermore, the keeper bars 52 can also be oriented vertically during the assembly of a tube bundle which includes sections which are arranged side by side.

As is schematically illustrated in FIG. 4, two adjacent grids 50, each supporting a section of a tube bundle, have a common boundary adjoining the keeper bars 52, one of which is shown in FIG. 4. The grids 50 are made of a plurality of parallel individual grid strips 60 which lie across the tubes 30 transverse to the tubes 30 and to the keeper bars 52. In FIG. 4, the grid strips 60 terminate behind the keeper bar 52, leaving a small space between the corresponding grid strips 60 of the adjacent grids 50. The row of tubes 30 of each section closest to the boundary engage the keeper bar 52 on its opposite sides.

Figure 5:
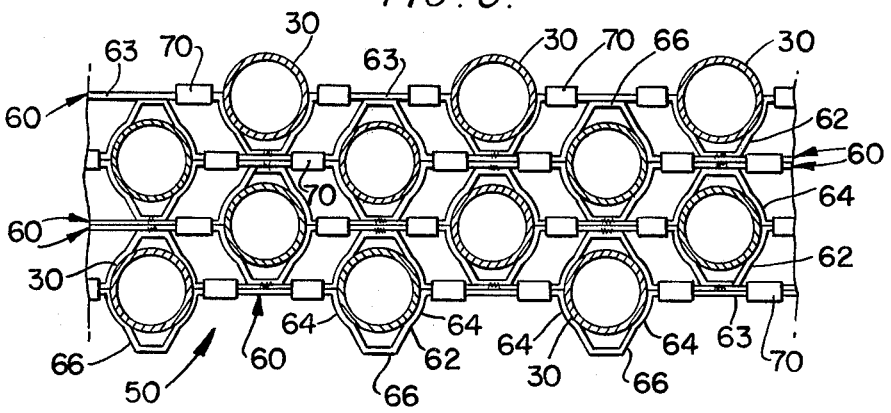
FIG. 5 is an enlarged view of a fragment of the support structure shown in FIG. 4.
Figure 6:
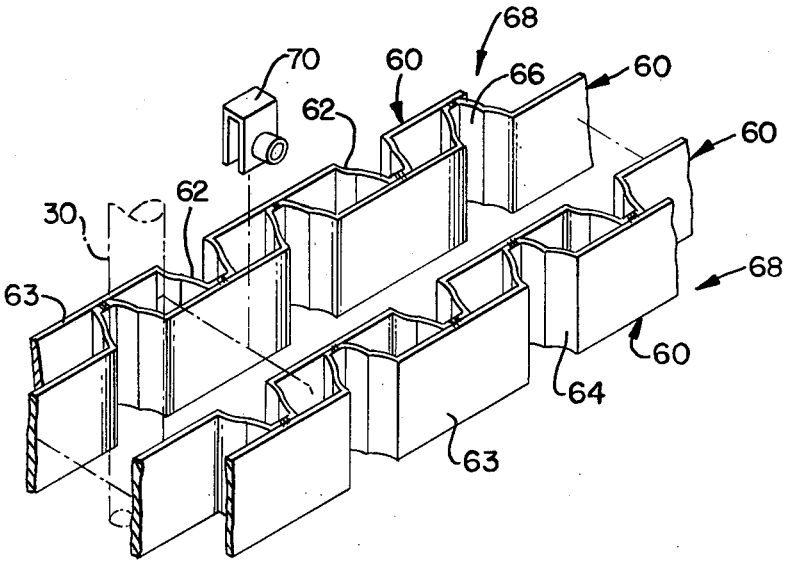
FIG. 6 is a perspective view of two pairs of grid strips aligned for assembly.

In FIG. 5, a portion of a cross section of a tube bundle with the grid strips 60 in place is illustrated. Each grid strip 60 is corrugated, defining a regular series of deformations or indentations 62 separated by flat sections 63. Each indentation 62 includes arcuate or curved portions 64 which are complementary to the outer circumferences of the tubes 30 and a trapezoidal crown portion 66 connecting the curved portions 64 and engaging a flat section 63 of an adjacent grid strip 60. FIGS. 5, 6 and 8 clearly show the arrangement of the grid strips 60 in grid strip pairs 68, sometimes called "wiggly pairs", with the deformations or indentations 62 of each grid strip 60 extending toward and abutting the flat portions 63 of the other grid strip 60 of the pair 68. The top surface of each trapezoidal crown portion 66 is welded or otherwise secured to the facing surface of the flat portion 63. The securing of the grid strips 60 into pairs 68 can be done prior to the assembly of the grid strips 60 with the tubes 30 to help minimize the time required for tube bundle assembly. The deformations or indentations 62 in each grid strip 60 are in alignment with and project away from the indentations 62 in the adjacent grid strip 60 in the adjacent pair 68, thereby co-operating to define arcuate openings sized and shaped to receive the tubes 30. The flat sections 63 of the grid strips 60 of a pair 68 are aligned with and are in abutment with the flat sections 63 of the adjacent pairs 68. The abutting flat sections 63 are held together by fasteners 70 such as removable spring-loaded steel clips or other suitable connecting means. It is desirable for the assembly of the grid 50 in the tube bundle that the connecting means be suitable for quickly and easily connecting the pairs 68 of grid strips 60. Two fasteners 70 may be used to secure the grid strip pairs 68 between each pair of adjacent tubes 30, as is illustrated in FIG. 5. However, as is shown in FIG. 8, where less strength or rigidity is required, a single fastener 70 can be used between adjacent pairs of tubes 30. For example, in the embodiment of the invention described, the lower section of the tube bundle may require two fasteners 70 between the tubes 30, since the lower section must support the weight of the upper section during assembly. Since the upper section has no such limitation, a single fastener 70 between the tubes 30 is sufficient.

Figure 7:
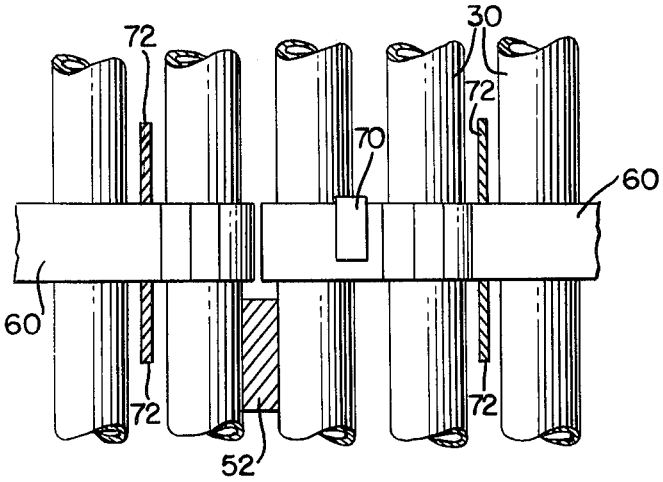
FIG. 7 is a cross section taken along the line 7—7 in FIG. 4.

FIG. 7 shows a fragmentary cross section of a tube bundle taken along the line 7—7 in FIG. 4 and including the boundary between two adjacent bundle sections. The left two tubes 30 are part of one bundle section and are held together by the grid strips 60 of one grid 50, while the three tubes 30 on the right side of the figure belong to another bundle section and are held together by the grid strips 60 of another grid 50. The grids 50 of the adjacent bundle sections are in alignment and the grid strips 60 of each grid 50 extend beyond the tubes 30. The keeper bar 52 engages the tube 30 of the adjacent sections and has a thickness which is greater than twice the extension of the grid strips 60 beyond the tube 30. Thus, the keeper bars 52 support the adjacent sections with respect to one another, protect the ends of the grid strips 60 and determine the amount of space between the tubes 30 of the adjacent sections.

As can be seen from FIGS. 4 and 7–10, the grid 50 of assembled grid strips 60 is given lateral stability by pairs of key strips 72 positioned along the sides of the grid strips 60 transverse to the grid strips 60 at selected locations along the length of the grid strips. The key strips 72 are positioned transverse to the tubes 30 between adjacent rows of the tubes 30 and are secured by a bridging plate 74 welded between the key strips 72 at their ends. Thus, the key strips 72 keep the grid strips 60 aligned in their stacked relationship. Additional pipe collars 52 are secured to selected tubes 30 along the sides of the grids 50 to prevent the grids 50 from shifting laterally along the lengths of the tubes 30.

Figure 9:
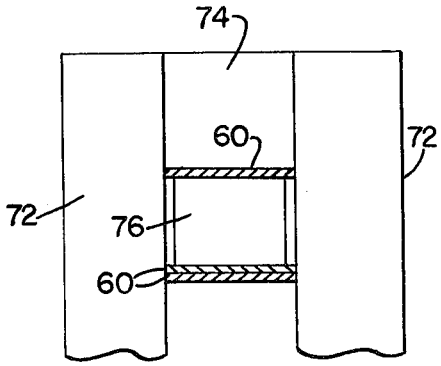
FIG. 9 is a cross section taken along the line 9—9 in FIG. 8.
Figure 10:
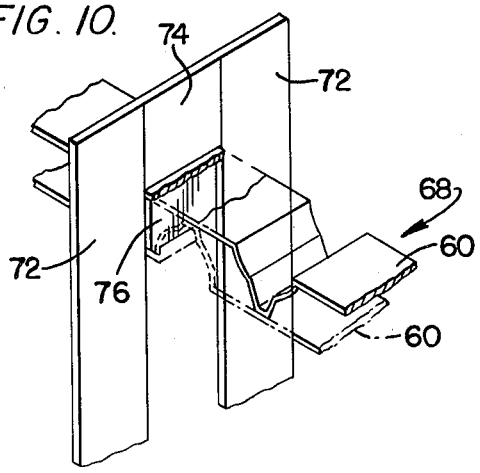
FIG. 10 is a perspective view of the key strips and grid strips shown in FIG. 9.

As is shown in FIGS. 9 and 10, reinforcing plates 76 are secured perpendicularly between the grid strips 60 in the pairs 68 which are along the periphery of a grid 50 and which, therefore, engage the bridging plates 74 of the key strips 72. The reinforcing plates 76 are positioned in planes containing the bridging plates 74 to add strength to the key strips 60 which engage the bridging plates and to distribute the load borne by such peripheral key strips 60 to other key strips 60.

Thus, it can be seen that a tube bundle can quickly be assembled by laying down a plurality of spaced grid strip pairs 68, laying down a layer of tubes 30 across the pairs 68, clipping additional pairs 68 to the previous pairs 68 around the tubes 30, laying the next layer of tubes 30, etc.

Although it is apparent from the foregoing that the present invention is particularly well suited for application to tube-type heat exchangers having bends in the tubes, it is understood that the scope of the present invention is not so limited, but rather extends to other applications. Also, various other changes and modifications may be made without departing from the spirit and scope of the present invention as recited in the appended claims and their legal equivalents.

What is claimed is:

1. A support structure for a bundle of tubes, comprising:

a plurality of parallel strips having a plurality of indentations and a plurality of flat sections, the strips being arranged in pairs, with the indentations in each strip of a pair projecting toward and being secured to the flat sections of the other strip of the pair, the indentations in each strip being in alignment with and projecting away from the indentations in the adjacent strip of an adjacent pair of strips, and fasteners connecting the flat sections of each strip of a pair of strips to flat sections of the adjacent strip of an adjacent pair of strips to define a support grid for a bundle of tubes.

2. The support structure of claim 1 wherein the fasteners are clips.

3. The support structure of claim 1 wherein the bundle comprises a plurality of sections each having a tube support grid, and at least one keeper bar is positioned between adjacent sections, said keeper bar extending across the facing surfaces of the adjacent sections and having flanges engaging tubes in each of the adjacent sections to prevent relative movement between the adjacent sections.

4. A support structure for a bundle of tubes, comprising:

a plurality of parallel strips having a plurality of indentations and a plurality of flat sections, the strips being arranged in pairs, with the indentations in each strip of a pair projecting toward and being secured to the other strip of the pair, the indentations in each strip being in alignment with and projecting away from the indentations in the adjacent strip of an adjacent pair of strips, and fasteners connecting the flat sections of each strip of a pair of strips to flat sections of the adjacent strip of an adjacent pair of strips to define a support grid for a bundle of tubes, wherein the bundle comprises a plurality of sections each having a tube support grid, and at least one keeper bar is positioned between adjacent sections, said keeper bar extending across the facing surfaces of the adjacent sections and having flanges engaging tubes in each of the adjacent sections to prevent relative movement between the adjacent sections.

5. The support structure of claim 4 wherein a plurality of keeper bars are positioned between adjacent sections.

6. A support structure for a bundle of tubes, comprising:

a plurality of parallel strips having a plurality of indentations and a plurality of flat sections, the strips being arranged in pairs, with the indentations in each strip of a pair projecting toward and being secured to the other strip of the pair, the indentations in each strip being in alignment with and projecting away from the indentations in the adjacent strip of an adjacent pair of strips, wherein each indentation includes curved portions for engaging one of the tubes of the bundle of tubes and a crown portion connecting the curved portions and engaging the other strip of a pair of strips; and fasteners connecting the flat sections of each strip of a pair of strips to flat sections of the adjacent strip of an adjacent pair of strips to define a support grid for a bundle of tubes.

7. The support structure of claim 6 wherein the crown portion is secured to said other strip.

8. A support structure for a bundle of tubes, comprising:

a plurality of parallel strips having a plurality of indentations and a plurality of flat sections, the strips being arranged in pairs, with the indentations in each strip of a pair projecting toward and being secured to the other strip of the pair, the indentations in each strip being in alignment with and projecting away from the indentations in the adjacent strip of an adjacent pair of strips, fasteners connecting the flat sections of each strip of a pair of strips to flat sections of the adjacent strip of an adjacent pair of strips to define a support grid for a bundle of tubes, and at least one key strip positioned along each side of the tube support grid, engaging each grid strip, the key strip on one side of the support grid being connected to the key strip on the other side of the support grid to maintain the grid strips in their relative positions.

9. The support structure of claim 8 wherein the ends of the key strips are connected to one another.

10. In combination, a bundle of tubes and a support structure therefor, comprising:

a plurality of parallel strips having a plurality of indentations and a plurality of flat sections, the strips being arranged in pairs, with the indentations in each strip of a pair projecting toward and being secured to the flat sections of the other strip of the pair, the indentations in each strip being in alignment with and projecting away from the indentations in the adjacent strip of an adjacent pair of strips, fasteners connecting the flat sections of each strip of a pair of strips to flat sections of the adjacent strip of an adjacent pair of strips to define a support grid for a bundle of tubes, and means fixed adjacent to the support grid on selected tubes in the bundle for preventing movement of the tube support grid along the length of the tubes.

11. The support structure of claim 10 wherein the movement preventing means comprise tube collars.

12. In combination, a bundle of tubes and a support structure therefor, comprising:

a plurality of parallel strips having a plurality of indentations and a plurality of flat sections, the strips being arranged in pairs, with the indentations in each strip of a pair projecting toward and being secured to the other strip of the pair, the indentations in each strip being in alignment with and projecting away from the indentations in the adjacent strip of an adjacent pair of strips, and fasteners connecting the flat sections of each strip of a pair of strips to flat sections of the adjacent strip of an adjacent pair of strips to define a support grid for a bundle of tubes, wherein the bundle comprises a plurality of sections each having a tube support grid, and at least one keeper bar is positioned between adjacent sections, said keeper bar extending across the facing surfaces of the adjacent sections and having flanges engaging tubes in each of the adjacent sections to prevent relative movement between the adjacent sections, and the tube support grids of adjacent sections are in alignment with one another and extend beyond the tubes of the sections toward one another, the keeper bar engaging the tubes of the adjacent sections and having a thickness greater than twice the extension of the tube support grids beyond the tubes of their respective sections, whereby the keeper bar supports the adjacent sections with respect to one another and protects the ends of the grids.

* * * * *